US005330178A

United States Patent [19]

Geishert, Sr.

[11] Patent Number: 5,330,178

[45] Date of Patent: Jul. 19, 1994

[54] GOLF BALL AND TEE POSITIONER APPARATUS

[76] Inventor: Edwin C. Geishert, Sr., 7720 Whistler Dr., Quincy, Mich. 49082

[21] Appl. No.: 145,411

[22] Filed: Oct. 29, 1993

[51] Int. Cl.[5] ..... A63B 57/00

[52] U.S. Cl. ..... 273/32.5

[58] Field of Search ..... 273/325

[56] References Cited

U.S. PATENT DOCUMENTS

| | | | |
|---|---|---|---|
| 1,863,140 | 6/1932 | Mulvaney | 273/32.5 |
| 2,609,198 | 9/1952 | Armstrong | 273/32.5 |
| 4,616,826 | 10/1986 | Trefts | 273/32.5 |
| 4,761,026 | 8/1988 | Warden et al. | 294/19.2 |
| 4,819,938 | 4/1989 | Hill | 273/32.5 |
| 4,949,961 | 8/1990 | Milano | 273/32.5 |
| 4,951,947 | 8/1990 | Kopfle | 273/32.5 |
| 4,969,646 | 11/1990 | Tobias | 273/32.5 |
| 5,080,357 | 1/1992 | Wolf | 273/32.5 |
| 5,205,598 | 4/1993 | Miller | 294/19.2 |

*Primary Examiner*—William H. Grieb

*Attorney, Agent, or Firm*—Flynn, Thiel, Boutell & Tanis

[57] ABSTRACT

Apparatus is provided for placing a golf ball and tee in the ground without the need for the golfer to bend over or kneel. The apparatus includes first and second elongated shafts laterally spaced apart and substantially parallel to one another. The first and second shafts have respective first and second handles proximate one another so as to be grippable by a golfer's hand. The first shaft includes a tee-holding foot member proximate an end thereof and the second shaft includes a ball-holding cupped member proximate an end thereof in opposing relation to the tee-holding foot member such that the golf ball and tee can be held between the tee-holding member and ball-holding member. The second shaft is movable relative to the first shaft and includes a coil spring for biasing the second shaft and ball-holding member thereon toward the tee-holding member on the first shaft to hold the golf ball and tee therebetween. The second shaft is movable after the tee is inserted in the ground away from said tee-holding means by movement of the second handle toward the first handle. This handle movement disengages the ball-holding member from the golf ball and allows lateral movement of the apparatus as a unit in a manner to disengage the tee-holding member from the tee inserted in the ground.

7 Claims, 4 Drawing Sheets

GOLF BALL AND TEE POSITIONER APPARATUS

FIELD OF THE INVENTION

The present invention relates to apparatus for positioning a golf ball on a tee in the ground in readiness for play without requiring the golfer to bend over or kneel to do so.

BACKGROUND OF THE INVENTION

Many golfers have physical restrictions due to injuries, diseases, replacements, etc. relating to the back, spine, hip, and other body regions that severely limit or prevent their teeing the ball for play in the usual manner. These golfers may require the assistance of another person to properly tee the golf ball for play.

Various apparatus have been devised in the past to assist such golfers in teeing the golf ball in the ground in readiness for play without the golfer's having to physically bend/stoop over at the waist or to kneel to do so. Devices for aiding in the teeing of the golf ball are described in U.S. Pat. Nos. 4,616,826, 4,819,938, 4,949,961, 4,969,646, 5,080,357, and 5,205,598. A golf ball retrieving device is described in U.S. Pat. No. 4,761,026.

SUMMARY OF THE INVENTION

The present invention provides apparatus for placing a golf ball and tee in the ground without the need for the golfer to bend/stoop over or kneel. Moreover, once the golf ball and tee are held by the apparatus of the invention, the tee can be inserted in the ground and the apparatus released from the teed ball by ergonomically advantageous one-hand manipulation of the apparatus. The teeing apparatus of the invention comprises first and second elongated shafts laterally spaced apart and substantially parallel to one another. The first and second shafts have respective first and second handles proximate one another so as to be grippable by a golfer's hand. The first shaft includes a tee-holding foot member proximate an end thereof and the second shaft includes a ball-holding cupped member proximate an end thereof in opposing relation to the tee-holding foot member such that the golf ball and tee can be held between the tee-holding member and ball-holding member. The second shaft is movable relative to the first shaft and includes a coil spring for biasing the second shaft and ball-holding member thereon toward the tee-holding member on the first shaft to hold the golf ball and tee therebetween. The second shaft is movable after the tee is inserted in the ground away from the tee-holding means by movement of the second handle toward the first handle. This handle movement disengages the ball-holding member from the golf ball and allows lateral movement of the apparatus as a unit in a manner to disengage the tee-holding member from the tee inserted in the ground. The golf ball is thereby teed and ready for play.

In one embodiment of the invention, the first and second shafts are connected in laterally spaced apart, parallel relation by a plurality of connector members extending transverse to the axes of the shafts.

In another embodiment of the invention, the second shaft is movable on a shaft axis that is coaxial with the axis of the tee held on the tee-holding means. The tee-holding means can comprise a foot member having a tee-receiving receptacle with an axis coaxial with the shaft axis. The tee-receiving receptacle includes an open side to allow the foot member to be disengaged from the tee by lateral movement of the apparatus after the tee is inserted in the ground.

The foot member includes a bottom surface adapted to engage the ground after the tee is inserted therein.

In still another embodiment of the invention, the ball-holding means comprises a cupped member for receiving a portion of the golf ball when the golf ball and tee are held between the cupped member and tee-holding foot member.

In still a further embodiment of the invention, a coil spring is disposed about the second shaft in a manner to bias the second shaft and ball-holding means thereon toward the tee-holding foot member.

BRIEF DESCRIPTION OF THE DRAWINGS

The invention will be described in more detail below with reference to the following drawings.

DETAILED DESCRIPTION

Figure 1:
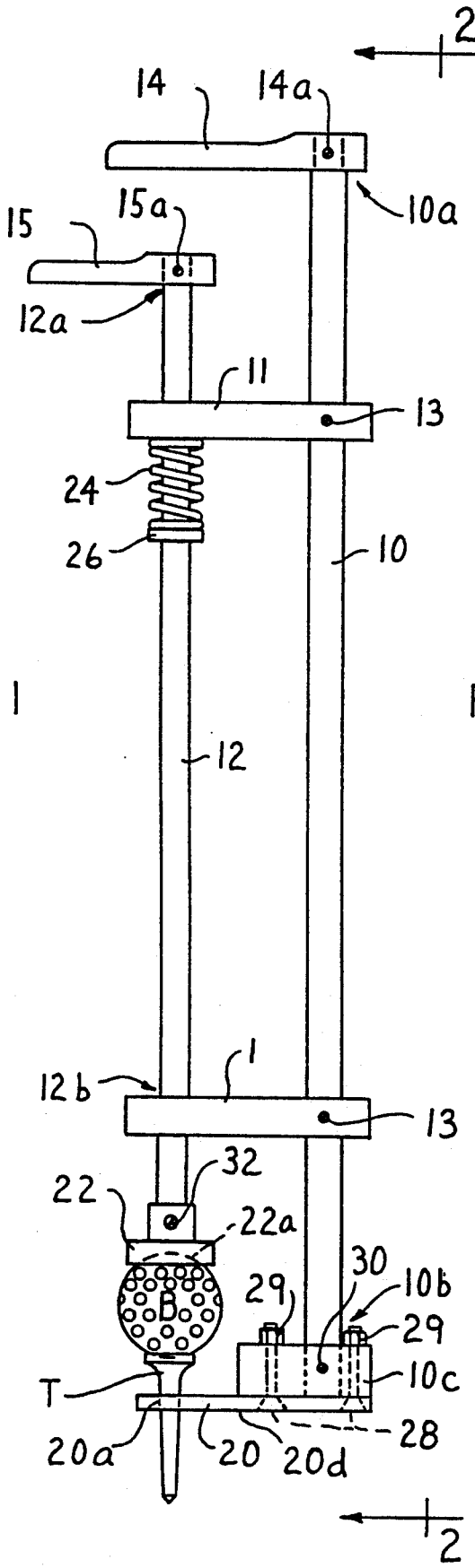
FIG. 1 is a side elevational view of apparatus of the invention.
Figure 2:
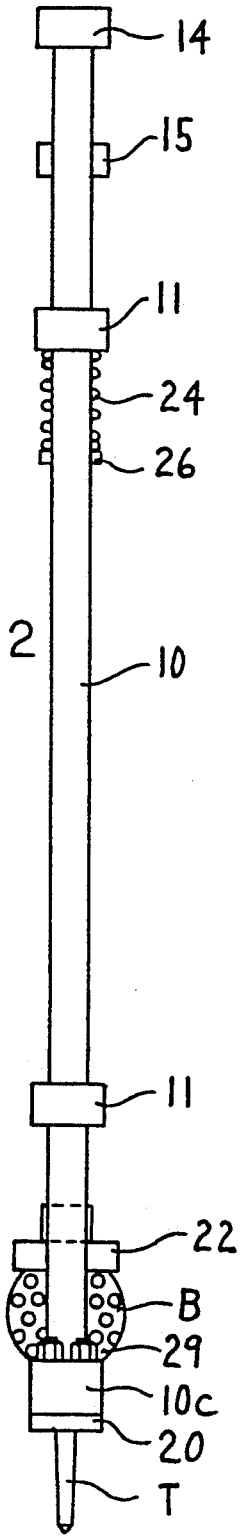
FIG. 2 is an elevational view of the apparatus of FIG. 1 in the direction of arrow 2—2.
Figure 3A:
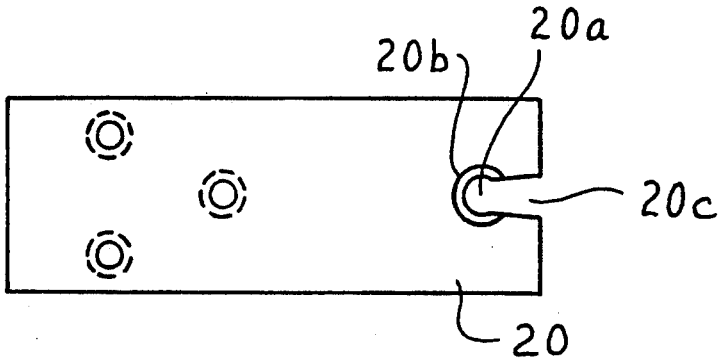
FIGS. 3A is a plan view of the bottom foot member of the apparatus.
Figure 3B:
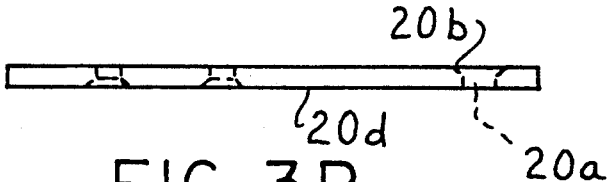
FIG. 3B is a side elevational view of the bottom foot member.
Figure 4:
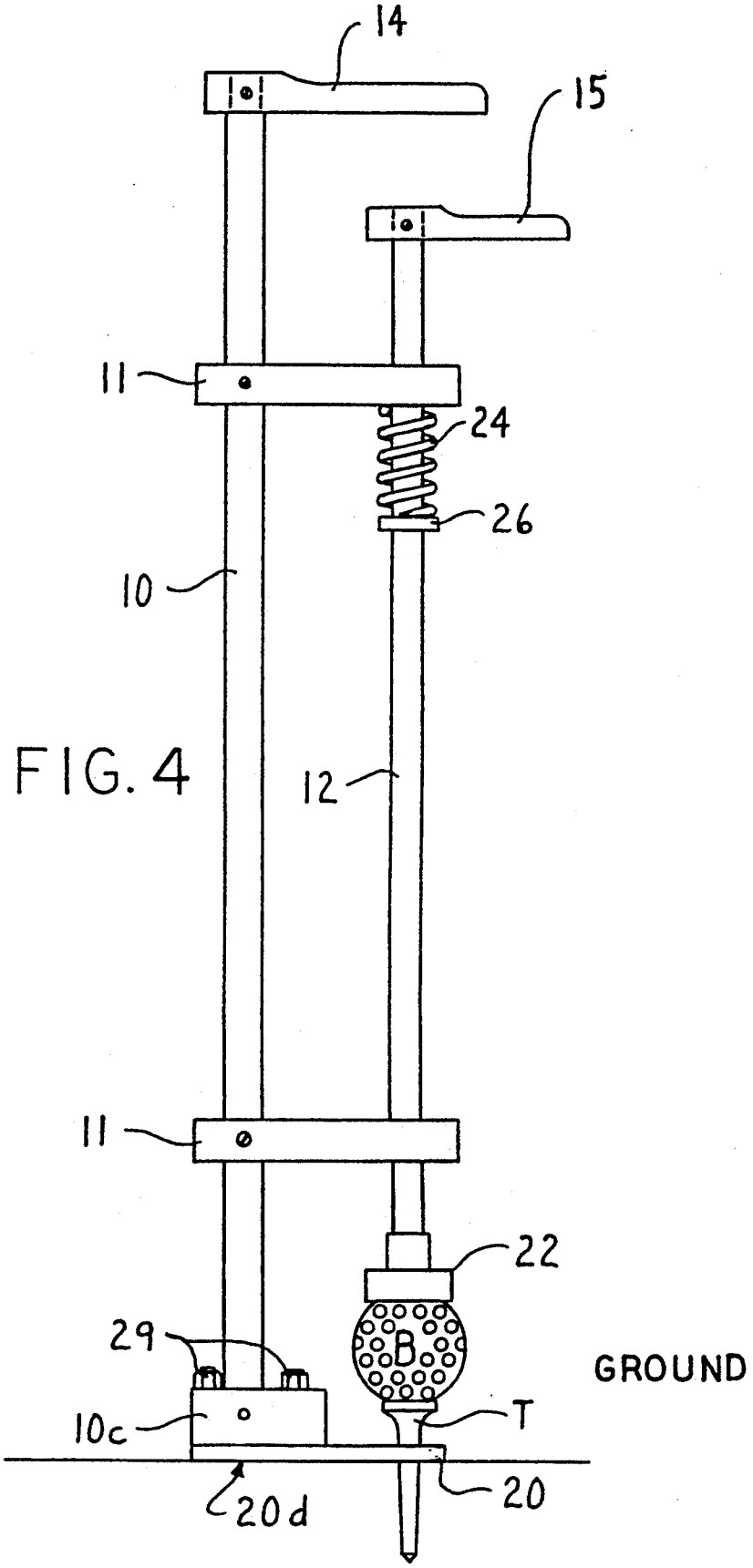
FIG. 4 is a side elevational of the apparatus with the tee inserted in the ground.
Figure 5:
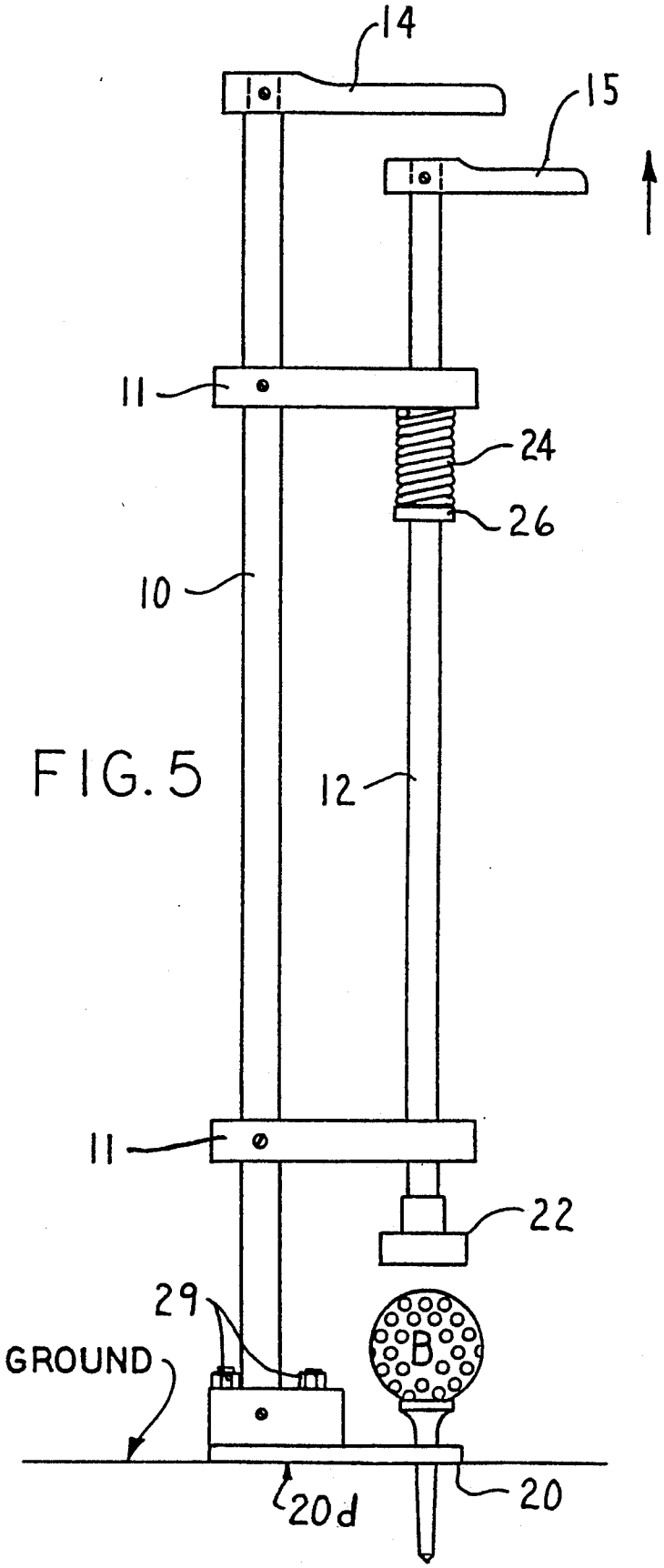
FIG. 5 is similar to FIG. 4 with the second shaft raised to disengage the ball-holding member from the golf ball with the tee inserted in the ground.

Apparatus in accordance with one embodiment of the invention for positioning a golf ball B and tee T in the ground without the need for the golfer to bend/stoop over or kneel is illustrated in FIGS. 1-5. The teeing apparatus is illustrated as comprising first and second elongated shafts 10, 12 laterally spaced apart and substantially parallel to one another. The first and second shafts 10, 12 are connected in laterally spaced apart, parallel, non-telescoping relation by a plurality of connector members 11 extending transverse to the axes of the shafts. The connector members 11 are each fixedly fastened to shaft 10 by a screw 13 and receive the shaft 12 to allow for movement of the shaft 12 relative to shaft 10. The connector members 11 include bores sized to receive the shafts 10, 12.

The first and second shafts 10, 12 have respective first and second handles 14, 15 proximate their upper ends **10*a*, 12*a*. The handles 14, 15 are proximate one another and extend parallel in the same direction perpendicular to the axes of shafts 10, 12 so as to be grippable by a golfer's hand similar to gripping a pistol. The handles 14, 15 are attached to the respective shafts 10, 12 by screws 14*a*, 15*a***.

The first shaft 10 includes a tee-holding foot member or means 20 proximate a lower end **10*b* thereof and the second shaft 12 includes a ball-holding cupped or recessed member or means 22 proximate a lower end 12*b* thereof in opposing relation to the tee-holding foot member 20 such that the golf ball B and tee T can be held between the tee-holding member 20 and ball-holding member 22. The tee-holding foot member 20 is fastened by screws 28 and nuts 29 to an enlarged end body 10*c* fastened on the shaft 10 by screw 30. The tee-holding foot member 20 comprises a tee-receiving receptacle 20***a* with an upstanding axis coaxial with the axis of the shaft 12, thereby holding the tee T coaxial with the axis of shaft 12. The tee-receiving receptacle 20*a* includes an arcuate, chamfered region 20*b* and also an open side or channel 20*c*. As will be explained, the open side 20*c* allows the foot member 20 to be disengaged from the tee T by lateral movement of the apparatus after the tee T is inserted in the ground. The foot member 20 includes a bottom surface 20*d* adapted to engage the ground after the tee T is inserted in the ground.

The ball-holding member 22 comprises a recess 22*a* receiving an upper portion of the golf ball B when the golf ball B and tee T are held between the ball-holding member 22 and tee-holding foot member 20. The ball-holding member 22 is fastened to shaft 12 by screw 32.

The second shaft 12 is movable relative to the first shaft 10 and includes a coil spring 24 for biasing the second shaft 12 and ball-holding member 22 thereon toward the tee-holding member 20 on the first shaft 10 to hold the golf ball B and tee T therebetween. The coil spring 24 is disposed about the second shaft 12 between a collar 26 fixed to the shaft 12 and the upper connector 11 so as to bias the second shaft 12 and ball-holding member 22 thereon toward the tee-holding foot member 20. The second shaft 12 is movable on a shaft axis that is coaxial with the axis of the tee T held on the tee-holding member 20.

In using the golf ball and tee positioning apparatus described above, the golfer initially holds the apparatus in inverted position; i.e. with the tee-holding and ball-holding members 20, 22 above the handles 14, 15. The golf ball B and tee T are positioned between the tee-holding and ball-holding members 20, 22 while moving the shaft 12 against the bias of coil spring 24. In particular, the tee T is slid through side opening or channel 20*c* into the receptacle 20*a*, and the ball upper region is positioned in the recess 22*a*. The spring 24 biases the shaft 12 and ball-holding member 22 toward the tee-holding member 20 to hold the ball B and tee T therebetween.

The apparatus then is inverted such that the tee-holding member 20 is proximate the ground where the tee T is to be inserted. The spring 24 continues to bias the shaft 12 and ball-holding member 22 toward the tee-holding member 20 to hold the ball B and tee T therebetween.

The golfer grips the handle 15 using a single hand in a manner similar to a pistol grip and inserts the tee T in the ground. This is accomplished by the golfer's pushing the handle 15 downwardly toward the ground until the tee T is inserted at the desired height in the ground. Handle 14 is then pushed toward the ground until the bottom surface 20*d* contacts the ground. The golfer then grips handles 14, 15 in a manner similar to a pistol grip and squeezes the handle 15 with his or her hand to move it toward the handle 14. This handle movement raises the ball-holding member 22 above the golf ball B to disengage therefrom, FIG. 5. Then, while the golfer continues to squeeze the handle 15 toward the handle 14, the golfer laterally slides the apparatus as a unit to disengage the foot member 20 from the tee T. In particular, the apparatus is slid as a unit in a direction of the side opening 20*c* to move the foot member 20 away from the tee T to disengage therefrom. The tee T and golf ball B thereon remain teed in the ground and ready for play.

The apparatus is advantageous in that the golfer does not need to bend over or stoop to position the golf ball B and tee T in the ground. Moreover, once the ball B and tee T are inserted between the tee-holding and ball-holding members with the apparatus inverted, the golfer can manipulate the apparatus using a single hand gripping the handles 14, 15.

The apparatus components, such as the shafts 10, 12, handles 14, 15, etc. can be made of any suitable material, such as wood, metal, or plastic. For example, the shafts 10, 12 can be made of solid wood shafts or metal tubing depending upon appearance and cost considerations. The same applies to the other apparatus components.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. Apparatus for placing a golf ball and tee in position, comprising, first and second elongated shafts laterally spaced apart and substantially parallel to one another, said first and second shafts having respective first and second handles proximate one another so as to be grippable by a golfer's hand, said first shaft having tee-holding means proximate an end thereof and said second shaft having a ball-holding means proximate an end thereof in opposing relation to said tee-holding means such that the golf ball and tee can be held between said tee-holding means and ball-holding means, said second shaft being movable relative to said first shaft and having means operably associated therewith for biasing said second shaft and ball-holding means thereon toward said tee-holding means on said first shaft to hold the golf ball and tee therebetween, said second shaft being movable after the tee is inserted in the ground away from said tee-holding means by movement of said second handle toward said first handle so to disengage said ball-holding means from the golf ball and allow movement of said apparatus in a manner to disengage said tee-holding means from the tee inserted in the ground.

2. The apparatus of claim 1, wherein said first and second shafts are connected in laterally spaced apart, substantially parallel relation by a plurality of connector members extending transverse to said first and second shafts.

3. The apparatus of claim 1, wherein said second shaft is movable on a shaft axis that is coaxial with the axis of the tee held on the tee-holding means.

4. The apparatus of claim 3, wherein said tee-holding means comprises a foot member having a tee-receiving receptacle with an axis coaxial with said shaft axis, said tee-receiving receptacle having an open side to allow the foot member to be disengaged from the tee by lateral movement of the apparatus after the tee is inserted in the ground.

5. The apparatus of claim 4, wherein the foot member includes a bottom surface adapted to engage the ground after the tee is inserted therein.

6. The apparatus of claim 1, wherein said ball-holding means comprises a cupped member for receiving a portion of the golf ball when the golf ball and tee are held between said cupped member and tee-holding means.

7. The apparatus of claim 1, wherein a coil spring is disposed about said second shaft in a manner to bias the second shaft and ball-holding means thereon toward said tee-holding means.

* * * * *